US007951756B2

(12) United States Patent
Konishi et al.

(10) Patent No.: US 7,951,756 B2
(45) **Date of Patent: *May 31, 2011**

(54) SYSTEM HAVING DLC CONTACT SURFACES, METHOD OF LUBRICATING THE SYSTEM, AND LUBRICANT FOR THE SYSTEM

(75) Inventors: Shozaburo Konishi, Yokohama (JP); Makoto Kano, Yokohama (JP); Takafumi Ueno, Yokohama (JP); Takao Ishikawa, Yokohama (JP)

(73) Assignees: Nippon Oil Corporation, Tokyo (JP); Nissan Motor Co., Ltd., Yokohama (JP)

( * ) Notice: Subject to any disclaimer, the term of this patent is extended or adjusted under 35 U.S.C. 154(b) by 766 days.

This patent is subject to a terminal disclaimer.

(21) Appl. No.: 10/567,311

(22) PCT Filed: Aug. 6, 2004

(86) PCT No.: PCT/JP2004/011375

§ 371 (c)(1),
(2), (4) Date: May 11, 2006

(87) PCT Pub. No.: WO2005/014763

PCT Pub. Date: Feb. 17, 2005

(65) Prior Publication Data

US 2007/0060483 A1 Mar. 15, 2007

(30) Foreign Application Priority Data

Aug. 6, 2003 (JP) ..... P2003-206197
Aug. 6, 2003 (JP) ..... P2003-206199
Aug. 21, 2003 (JP) ..... P2003-297686

(51) Int. Cl.

| | |
|---|---|
| ***C01G 39/06*** | (2006.01) |
| ***C10M 137/10*** | (2006.01) |
| ***C10M 169/04*** | (2006.01) |
| ***C10M 173/02*** | (2006.01) |
| ***B32B 9/00*** | (2006.01) |

(52) U.S. Cl. ..... 508/167; 508/433; 508/109; 508/154; 508/179; 428/408

(58) Field of Classification Search ..... 508/167, 508/433, 109, 154, 179; 428/408
See application file for complete search history.

(56) References Cited

U.S. PATENT DOCUMENTS

| | | | | |
|---|---|---|---|---|
| 5,282,990 | A | 2/1994 | Yoneto et al. | |
| 6,333,298 | B1 | 12/2001 | Waddoupe et al. | |
| 6,508,416 | B1 * | 1/2003 | Mastro et al. | 239/585.1 |
| 6,543,394 | B2 * | 4/2003 | Tinney | 123/1 A |
| 2002/0086803 | A1 * | 7/2002 | Berlowitz et al. | 508/371 |
| 2003/0162672 | A1 | 8/2003 | Shirahama et al. | |
| 2004/0092405 | A1 | 5/2004 | Konishi et al. | |
| 2005/0241216 | A1 * | 11/2005 | Clark et al. | 44/436 |
| 2005/0272616 | A1 * | 12/2005 | Yagishita | 508/460 |

FOREIGN PATENT DOCUMENTS

| | | | |
|---|---|---|---|
| EP | 0931827 | | 7/1999 |
| EP | 1087008 | | 3/2001 |
| EP | 1167497 | | 1/2002 |
| JP | 2000-297373 | A | 10/2000 |
| JP | 2001-192864 | A | 7/2001 |
| JP | 2001-316686 | A | 11/2001 |
| WO | WO-93/21289 | A1 | 10/1993 |
| WO | 03/033629 | A1 | 4/2003 |

OTHER PUBLICATIONS

The Effect of ZDDP and MoDTC Additives on Friction Properties of DLC and Steel Cam Follower in Engine Oil, M Kano & Y. Yasuda, Absrtacts of Papers from 2nd World Tribology Congress, Sep. 3-7, 2001, Vienna.

Japanese Society of Tribologists, Congress Proceeding, Tokyo 1999, 5, p. 11-12, Kano, et al.

International Search Report on Patentability for PCT/JP2004/011375 issued May 8, 2006.

Tung S C et al.; "Tribological investigation of piston ring coatings operating in an alternative fuel and engine oil blend" Tribology Transactions, The Society, Park Ridge, IL, US, vol. 45, No. 3, Jan. 1, 2002, pp. 381-389, XP009105518 ISSN: 1040-2004 *the whole document*.

Yukata Mabuchi et al., "Diamond_Like Carbon Coating for Reducing Valvetrain Friction" SAE Technical Paper Series, Society of Automotive Engineers, Warrendale, PA, US, Jan. 1, 2004, XP009105548 ISSN: 0148-7191 *the whole document*.

* cited by examiner

*Primary Examiner* — Glenn A Caldarola
*Assistant Examiner* — Vishal Vasisth
(74) *Attorney, Agent, or Firm* — Jason D. Voight

(57) ABSTRACT

The present invention relates to a system wherein a pair of relatively movable, facing DLC contact surfaces at least one of which is coated with a DLC film, are further lowered in friction, and the low friction property is stably maintained. The present invention also relates to a lubricant for the system, and a lubricating method. The lubricant for the system having the DLC contact surfaces contains lubricant base oil (A) mainly composed of base oil (X), and sulfur-containing molybdenum complex (B). The base oil (X) is at least one of hydrocracked mineral oils, wax-isomerized mineral oils, and poly-α-olefin base oils, and has a kinematic viscosity of 2 to 20 $mm^2/s$ at 100° C., a total aromatic content of not higher than 5 mass %, and a total sulfur content of not higher than 0.005 mass %.

12 Claims, No Drawings

SYSTEM HAVING DLC CONTACT SURFACES, METHOD OF LUBRICATING THE SYSTEM, AND LUBRICANT FOR THE SYSTEM

This application is a 371 of PCT/JP04/11375, filed Aug. 6, 2004.

FIELD OF ART

The present invention relates to a system, such as an internal combustion engine, having a pair of relatively movable, facing diamond-like carbon (DLC) contact surfaces at least one of which is coated with a DLC film, in particular, to a system, such as an internal combustion engine, having both the DLC contact surfaces and non-DLC contact surfaces having no DLC films. The present invention also relates to a lubricant for the above system, and a method of lubricating a system having DLC contact surfaces with the lubricant.

BACKGROUND ART

Global environmental issues, such as global warming and ozone depletion, have recently been coming to the front. $CO_2$ emission, in particular, which is said to have a significant impact on global warming, is a considerable concern, and its regulation standards are attracting interest in each country.

One of the major challenges in $CO_2$ reduction is to reduce energy loss caused by friction loss in machinery, systems, and the like, in particular, to reduce vehicle fuel consumption. For reducing friction of parts having relatively movable, facing contact surfaces in engines and the like, such as sliding surfaces, rotating surfaces, or rolling surfaces, an important role is played by materials forming such contact surfaces, and lubricants for lubricating such contact surfaces adapted to each material.

The material forming the contact surfaces is required to give an excellent anti-wear property and a low frictional coefficient to the parts in engines or the like under severe frictional wearing. For these purposes, various hard thin film materials have recently been employed. For example, a DLC material is expected as a low friction material for its lower frictional coefficient in the air in the absence of a lubricant, compared to an anti-wearing hard coating material, such as TiN and CrN.

For reducing energy loss in lubricants, for example, for improving engine fuel consumption, there have been proposed to reduce viscous resistance in hydrodynamic lubrication areas and agitation resistance in engines by lowering the viscosity of lubricants, and to reduce frictional losses in mixed and boundary lubrication areas by adding optimum friction modifiers and various additives. The friction modifiers have widely been researched, in particular, organic molybdenum compounds, such as molybdenum dithiocarbamate (MoDTC) and molybdenum dithiophosphate (MoDTP), and lubricants containing organic molybdenum compounds have been developed and achieving effects, which exhibit an excellently low frictional coefficient on conventional steel sliding surfaces in the initial stage of use.

On the other hand, it has been reported that DLC materials, which have an excellent low friction property in the air, can offer only limited friction reducing effect in the presence of a lubricant (Non-patent Publication 1). It has also been reported that application of a lubricant containing an organic molybdenum compound to DLC materials does not result in sufficient friction reducing effect (Non-patent Publication 2).

Non-patent Publication 1: Japanese Society of Tribologists, Congress Proceeding, Tokyo, 1999.5, p11-12, Kano et al.
Non-patent Publication 2: World Tribology Congress 2001.9, Vienna, Proceeding p 342, Kano et al.

SUMMARY OF THE INVENTION

It is an object of the present invention to provide a system having a pair of relatively movable, facing DLC contact surfaces at least one of which is covered with a DLC film, in particular a system having both a pair of DLC contact surfaces and a pair of relatively movable, facing non-DLC contact surfaces having no DLC films, wherein the friction between these contact surfaces are further reduced and such low friction property is stably maintained.

It is another object of the present invention to provide a lubricant for a system having DLC contact surfaces, that is suitable for further reducing friction and stably maintaining the low friction property in a system having the DLC contact surfaces, in particular in a system having both the DLC contact surfaces and the non-DLC contact surfaces.

It is still another object of the present invention to provide a method of lubricating a system having DLC contact surfaces, which further reduces friction in a system having the DLC contact surfaces, in particular in a system having both the DLC contact surfaces and the non-DLC contact surfaces, and lubricates the system with stably maintained low friction property.

According to the present invention, there is provided a system having DLC contact surfaces, comprising:

a pair of relatively movable, facing DLC contact surfaces at least one of which is covered with a DLC film, and a lubricant (L) interposed between said DLC contact surfaces, said lubricant (L) comprising a lubricant base oil (A) containing a below-mentioned base oil (X) as a main component, and a sulfur-containing molybdenum complex (B)

The base oil (X) consists at least one of a hydrocracked mineral oil, a wax-isomerized mineral oil, and a poly-α-olefin base oil, and has a kinematic viscosity of 2 to 20 $mm^2/s$ at 100° C., a total aromatic content of not higher than 5 mass %, and a sulfur content of not higher than 0.005 mass %.

According to the present invention, there is also provided a method of lubricating the above system, comprising lubricating a pair of relatively movable, facing DLC contact surfaces at least one of which is coated with a DLC film, with the above lubricant (L) interposed between the DLC contact surfaces.

According to the present invention, there is also provided a lubricant for lubricating a system having a pair of relatively movable, facing DLC contact surfaces at least one of which is coated with a DLC film, said lubricant comprising:

a lubricant base oil (A) having a base oil (X) as a main component, wherein said base oil (X) consists at least one of a hydrocracked mineral oil, a wax-isomerized mineral oil, and a poly-α-olefin base oil, and has a kinematic viscosity of 2 to 20 $mm^2/s$ at 100° C., a total aromatic content of not higher than 5 mass %, and a sulfur content of not higher than 0.005 mass %, and a sulfur-containing molybdenum complex (B).

According to the present invention, there is also provided use of a lubricant (L) comprising a lubricant base oil (A) containing a base oil (X) as a main component and a sulfur-containing molybdenum complex (B), for the lubrication of a pair of relatively movable, facing DLC contact surfaces at least one of which is coated with a DLC film.

The lubricant of the present invention lubricates, at low friction, a pair of relatively movable, facing DLC contact surfaces at least one of which is coated with a DLC film, such as sliding surfaces, rotating surfaces, rolling surfaces, and the like, and also stably maintains such low friction property. Thus the present lubricant is useful not only for a system wherein all the contact surfaces in the system are the DLC contact surfaces, but also for a system having at least one pair of DLC contact surfaces and at least one pair of non-DLC contact surfaces. Further, both the low friction motion system and the lubricating method according to the present invention employ the above lubricant of the present invention, so that the system and the method provide wide contribution to energy saving in the fields of various machinery and systems having DLC contact surfaces and required to have low friction property.

PREFERRED EMBODIMENTS OF THE INVENTION

The present invention will now be explained in detail.

The system according to the present invention has a pair of relatively movable, facing DLC contact surfaces at least one of which is coated with a DLC film. The pair of DLC contact surfaces may have one surface coated with a DLC film and the other surface made of a metal or non-metal material with or without a coating film other than a DLC film thereon, or may alternatively have both surfaces coated with DLC films.

The system of the present invention may have all the contact surfaces therein formed as the DLC contact surfaces, but preferably have at least one pair of DLC contact surfaces and at least one pair of non-DLC contact surfaces having no DLC films and made of a metal or non-metal material with or without a coating film other than a DLC film.

A pair of relatively movable, facing contact surfaces include sliding surfaces, rotating surfaces, rolling surfaces, and the like contact surfaces, wherein one or both of the facing surfaces move to result in relative motion of the surfaces.

The DLC material forming the DLC film is an amorphous material composed mainly of carbon elements, and includes both carbon bonds in the diamond structure ($SP^3$ bond structure) and in the graphite bond ($SP^2$ bond). Specifically, the DLC material may be a-C (amorphous carbon) consisting solely of carbon elements, a-C:H (hydrogenated amorphous carbon) containing hydrogen, or MeC (metal carbide) having a metal element, such as titanium (Ti) or molybdenum (Mo). The present invention preferably has DLC contact surfaces having at least one surface coated with an a-C based material without hydrogen as the DLC material, for its ability to provide remarkable friction reducing effect.

The material of the substrate over which the DLC film is formed is not particularly limited, and an iron-based material may preferably be used. The DLC film may be formed by a conventional PVD or CVD method.

The material forming the substrate over which the DLC film is formed, the material forming the non-DLC contact surfaces, and the material, in the DLC contact surfaces wherein one is coated with a DLC film and the other is not, forming such other surface, are not particularly limited. In any case, a metallic material may be used, such as iron-, aluminum-, magnesium-, or titanium-based material. In particular, iron-, aluminum-, and magnesium-based materials are preferred since these materials are conveniently used in a pair of relatively movable, facing contact surfaces in existing machinery and systems, and widely contribute to energy saving in various fields. For producing the above contact surfaces, a non-metallic material may also be used, such as resins, plastics, or carbons. The surface formed with a metallic or non-metallic material may be coated with a various kinds of thin films other than a DLC film, such as a TiN or CrN film. It is preferred that such a thin film is formed over the surface of a substrate made of a metallic material, such as an iron-, aluminum-, magnesium-, or titanium-based material.

The iron-based material is not particularly limited, and not only iron of high purity, but also various iron-based alloys may be used, wherein carbon, nickel, copper, zinc, chromium, cobalt, molybdenum, lead, silicon, titanium, or two or more kinds of these are arbitrarily combined with iron. Specific examples of the iron-based material may include carburized steel SCM420 and SCr420 (JIS).

The aluminum-based material is not particularly limited, and not only aluminum of high purity, but also various aluminum-based alloys may be used. For example, hypoeutectic or hypereutectic aluminum alloys containing 4 to 20 mass % silicon (Si) and 1.0 to 5.0 mass % copper (Cu) are preferred. Preferred examples of the aluminum alloys may include AC2A, AC8A, ADC12, and ADC14 (JIS).

The magnesium-based material may be, for example, magnesium-aluminum-zinc-based (Mg—Al—Zn), magnesium-aluminum-rare earth metal-based (Mg—Al-REM), magnesium-aluminum-calcium-based (Mg—Al—Ca), magnesium-zinc-aluminum-calcium-based (Mg—Zn—Al—Ca), magnesium-aluminum-calcium-rare earth metal-based (Mg—Al—Ca-REM), magnesium-aluminum-strontium-based (Mg—Al—Sr), magnesium-aluminum-silicon-based (Mg—Al—Si), magnesium-rare earth metal-zinc-based (Mg-REM-Zn), magnesium-silver-rare earth metal-based (Mg—Ag-REM), or magnesium-yttrium-rare earth metal-based (Mg—Y-REM) material, or an arbitrary combination of these materials. Specifically, AZ91, AE42, AX51, AXJ, ZAX85, AXE522, AJ52, AS21, QE22, or WE43 (ASTM) may be used.

The surface roughness (Ra) of the contact surfaces may be measured in accordance with JIS B 0601-1994, and may usually be not more than 0.1 μm, preferably not more than 0.08 μm, for stability of motion of the contact surfaces. If Ra is more than 0.1 μm, local scuffing may occur to remarkably increase the friction coefficient.

The surface coated with a DLC film or with a thin film other than a DLC film, preferably has a surface hardness of Hv1000 to 3500 in Vickers microhardness (10 g load), and a film thickness of 0.3 to 2.0 μm. If the surface hardness Hv of the thin film is less than 1000, or if the film thickness is less than 0.3 μm, the coating is prone to wear out, whereas if the surface hardness Hv is over 3500, or if the film thickness is over 2.0 μm, the coating is prone to flake.

When the iron-based material is used for forming the substrate of the other of the contact surfaces without a DLC film, the surface hardness is preferably HRC 45 to 60 in Rockwell hardness C scale. This is advantageous for maintaining the durability of the facing DLC film even in the contact motion under high surface pressure conditions of about 700 MPa, as typically observed with cam follower members. If the surface hardness of the iron-based material is less than HRC45, the facing DLC film may be prone to buckle and flake under high surface pressure.

When the aluminum-based material is used for forming the substrate of the other of the contact surfaces without a DLC film, the surface hardness $H_B$ is preferably 80 to 130 in Brinel hardness. If the surface hardness of the aluminum-based material is less than $H_B$ 80, the surface of the aluminum-based material may be prone to wear.

When the magnesium-based material is used for forming the substrate of the other of the contact surfaces without a DLC film, the surface hardness $H_B$ is preferably 45 to 95 in Brinel hardness. If the surface hardness of the magnesium-based material is less than $H_B$ 45, the surface of the magnesium-based material may be prone to wear.

The lubricant (L) to be used in the system and the lubricating method of the present invention may be the lubricant for lubricating a system having DLC contact surfaces of the present invention.

The lubricant according to the present invention contains lubricant base oil (A) having base oil (X) as a main component, sulfur-containing molybdenum complex (B), and optionally at least one of friction modifier (C), metal detergent (D), and phosphorus-based anti-wear agent (E), as desired.

Base oil (X) is a base oil of a particular property, composed at least one of a hydrocracked mineral oil, a wax-isomerized mineral oil, and a poly-α-olefin base oil.

The hydrocracked mineral oil used in base oil (X) is not particularly limited as long as the oil has the properties to be discussed later, and may be produced by a conventional method.

The wax-isomerized mineral oil used in base oil (X) is not particularly limited as long as the oil has the properties to be discussed later, and may be produced by isomerizing wax rich in normal paraffin obtained from the dewaxing process of a lubricant, slack wax, or GTL (gas-to-liquid) wax obtained from the Fischer-Tropsch reaction, into isoparaffin by a conventional process. The wax-isomerized mineral oil may also be produced by a suitable combination of optional steps, such as distillation, solvent refining, solvent dewaxing, hydrodewaxing, and hydrorefining.

The poly-α-olefin base oil used in base oil (X) may be polymers or copolymers of C2-C30, preferably C8-C16 α-olefins, or hydrides thereof. Specifically, poly-α-olefins such as 1-octene or 1-decene oligomer, or hydrides thereof, may preferably be used.

The kinematic viscosity of base oil (X) at 100° C. is 2 to 20 $mm^2/s$, preferably 3 to 10 $mm^2/s$, more preferably 3.5 to 5 $mm^2/S$ By setting the kinematic viscosity at 100° C. of base oil (X) to 2 $mm^2/s$ or higher, a lubricant may be obtained which is capable of forming a sufficient oil film, has excellent lubricity, and undergoes lower evaporation loss of the base oil under severe conditions. By setting the kinematic viscosity at 100° C. of base oil (X) to 20 $mm^2/s$ or lower, the fluid resistance of the base oil upon agitation is kept from being too high, and a lubricant exhibiting a low friction resistance on the lubricating site may be obtained.

Base oil (X) has a total aromatic content of not higher than 5 mass %, preferably not higher than 3 mass %, more preferably 0 to 2 mass %. At a reduced total aromatic content, low friction on the DLC contact surfaces is achieved and maintained more advantageously.

The total aromatic content as used herein means the content of aromatic fraction measured in accordance with ASTM D2549. The aromatic fraction usually contains alkylbenzene, alkylnaphthalene, anthracene, phenanthrene, and alkylation products thereof; compounds produced by condensation of four or more benzene rings; or compounds having a heteroaromatic ring, such as pyridines, quinolines, phenols, or naphthols.

The sulfur content of base oil (X) is not higher than 0.005 mass %, preferably not higher than 0.002 mass %. Most preferably, base oil (X) is substantially free of sulfur. By reducing the sulfur content of base oil (X), still lower friction on the DLC contact surfaces is achieved and maintained more advantageously.

The viscosity index of base oil (X) is not particularly limited, and is usually not lower than 80, preferably not lower than 100, more preferably not lower than 120, most preferably not lower than 125. The upper limit of the viscosity index is usually 200 to 300. By selecting base oil (X) with a high viscosity index, a lubricant having not only excellent viscosity property at low temperatures but also superior friction reducing effect, may be obtained.

Lubricant base oil (A) is most preferably composed solely of base oil (X), but may optionally contain a small amount of other base oils as long as the effects of the present invention are not impaired remarkably, for example, at not more than 50mass %, preferably not more than 30 mass %, more preferably not more than 20 mass %, most preferably not more than 10 mass %, of the total amount of lubricant base oil (A).

Such other base oils may be mineral oils that do not have the above properties, hydrocracked oils obtained under mild conditions, synthetic oils other than the poly-α-olefin base oils, or the like. Examples of the mineral oils that do not have the above properties may include solvent refined oils and solvent dewaxed oils. Examples of the synthetic oils other than the poly-α-olefin base oils may include alkylnaphthalene; alkylbenzene; diesters, such as ditridecyl glutarate, dioctyl adipate, diisodecyl adipate, ditridecyl adipate, and dioctyl sebacate; polyol esters, such as trimethylolpropane caprylate, trimethylolpropane pelargonate, pentaerythritol-2-ethylhexanoate, and pentaerythritol pelargonate; and mixtures of two or more of these. When lubricant base oil (A) contains such other base oils, the sulfur content of lubricant base oil (A) is not particularly limited. However, for facilitating maintenance of the low friction property, the sulfur content is preferably not higher than 0.005 mass %, more preferably not higher than 0.001 mass %, and most preferably substantially no sulfur is contained.

Component (B) is an organic molybdenum complex having sulfur in its molecule, and may be, for example, a complex of a molybdenum compound, for example, molybdenum oxide, such as molybdenum dioxide or molybdenum trioxide; molybdic acid, such as o-molybdic acid, p-molybdic acid, or sulfurized (poly)molybdic acid; molybdate, such as a metal salt or an ammonium salt of the molybdic acid; molybdenum sulfide, such as molybdenum disulfide, molybdenum trisulfide, molybdenum pentasulfide, or molybdenum polysulfide; sulfurized molybdic acid; a metal salt or an amine salt of sulfurized molybdic acid; molybdenum halide, such as molybdenum chloride, and a sulfur-containing organic compound, such as dihydrocarbyldithiocarbamate, dihydrocarbyldithiophosphate, alkyl(thio)xanthate, thiadiazole, mercaptothiadiazole, thiocarbonate, tetrahydrocarbyl thiuram disulfide, bis(di(thio)hydrocarbyldithiophosphonate)disulfide, organic (poly)sulfide, or sulfurized ester, or other organic compounds.

Preferred examples of component (B) may include molybdenum dithiocarbamate, such as sulfurized molybdenum dihydrocarbyldithiocarbamate, sulfurized oxymolybdenum dihydrocarbyldithiocarbamate, oxymolybdenum dihydrocarbyldithiocarbamate, and thio- or polythio-trinuclear molybdenum comprising bonded thereto ligands such as dithiocarbamate; and molybdenum dithiophosphate, such as sulfurized molybdenum dihydrocarbyldithiophosphate, sulfurized oxymolybdenum dihydrocarbyldithiophosphate, and oxymolybdenum dihydrocarbyldithiophosphate, with molybdenum dithiocarbamate being most preferred.

The hydrocarbyl group is a C2-C30 hydrocarbon group, and may be a hydrocarbon group, such as a straight or branched C2-C30, preferably C5-C18, more preferably C6-C13 alkyl group; a C6-C18, preferably C10-C15 aryl group; or an alkylaryl group. Among these, straight or branched C6-C13 alkyl groups are particularly preferred.

In the lubricant of the present invention, the content of component (B) is not particularly limited, and may usually be 0.001 to 0.2 mass %, preferably 0.02 to 0.1 mass %, more preferably 0.03 to 0.1 mass %, of the total amount of the lubricant in terms of molybdenum elements, for excellent low friction property.

Component (C), a friction modifier, may preferably be an oxygen-containing organic compound or amines. Also preferred is at least one of C1-C40 esters, amines, amides, alcohols, ethers, carboxylic acids, ketones, aldehydes, and carbonates, and derivatives thereof. Among these, at least one of, or a mixture of two or more of C3-C30, preferably C3-C20 aliphatic esters, aliphatic amines, aliphatic amides, aliphatic alcohols, and aliphatic carboxylic acids, and derivatives thereof, is preferred.

The oxygen-containing organic compound may be any organic compound as long as it has oxygen in its molecule, and may be a compound composed of carbon, hydrogen, and oxygen, or a compound having, in addition to these elements, halogen, such as fluorine or chlorine, nitrogen, sulfur, phosphorus, boron, metal, or the like, in its molecule.

Examples of the oxygen-containing organic compound may include oxygen-containing organic compounds having at least one of a hydroxyl group, a carboxyl group, a carbonyl group, an ester bond, and an ether bond, and derivatives thereof. Among these, preferred compounds are oxygen-containing organic compounds having at least one of a hydroxyl group, a carboxyl group, a carbonyl group, and an ester bond, and derivatives thereof; more preferred compounds are oxygen-containing organic compounds having at least one of a hydroxyl group, a carboxyl group, and an ester bond, and derivatives thereof; and most preferred compounds are oxygen-containing organic compounds having at least one of a hydroxyl group and a carboxyl group, and derivatives thereof. In particular, oxygen-containing organic compounds having a hydroxyl group, and derivatives thereof are particularly preferred for their ability to further reduce friction between the DLC contact surfaces. It is preferred that these compounds have two or more hydroxyl groups. It is also preferred that the oxygen-containing organic compounds contain little or no sulfur.

The above-mentioned derivatives may typically be a compound obtained by reacting the compound composed of carbon, hydrogen, and oxygen, with, for example, a nitrogen-containing compound, a phosphorus-containing compound, sulfur, a sulfur containing compound, a boron-containing compound, halogen, a halogen-containing compound, metal, an inorganic or organic metal-containing compound, or alkylene oxide.

Examples of the oxygen-containing organic compound may include oxygen-containing compounds, such as alcohols, carboxylic acids, esters, ethers, ketones, aldehydes, and carbonates, and these compounds further having at least one of a hydroxyl group, a carboxyl group, a carbonyl group, and an ester bond bonded thereto, derivatives thereof, and mixtures of two or more of these.

The alcohols maybe, for example, monohydric, dihydric, trihydric or higher alcohols, or mixtures of two or more of these.

The monohydric alcohol has one hydroxyl group in its molecule, and may be, for example, C1-C40 monohydric alkyl alcohol having a straight or branched alkyl group, C2-C40 monohydric alkenyl alcohol having a straight or branched alkenyl group with the double bond at an arbitrary position, C3-C40 monohydric (alkyl)cycloalkyl alcohol having a straight or branched alkyl group with alkyl and hydroxyl groups substituted at arbitrary positions, (alkyl)aryl alcohol having a straight or branched alkyl group with alkyl and hydroxyl groups substituted at arbitrary positions, 6-(4-oxy-3,5-di-tert-butylanilino)-2,4-bis(n-octylthio)-1,3,5-triazine, or a mixture of two or more of these.

Examples of the monohydric alkyl alcohols may include methanol; ethanol; propanol, such as 1-propanol and 2-propanol; butanol, such as 1-butanol, 2-butanol, 2-methyl-1-propanol, and 2-methyl-2-propanol; pentanol, such as 1-pentanol, 2-pentanol, 3-pentanol, 2-methyl-1-butanol, 3-methyl-1-butanol, 3-methyl-2-butanol, 2-methyl-2-butanol, and 2,2-dimethyl-1-propanol; hexanol, such as 1-hexanol, 2-hexanol, 3-hexanol, 2-methyl-1-pentanol, 2-methyl-2-pentanol, 2-methyl-3-pentanol, 3-methyl-1-pentanol, 3-methyl-2-pentanol, 3-methyl-3-pentanol, 4-methyl-1-pentanol, 4-methyl-1-pentanol, 4-methyl-2-pentanol, 2,3-dimethyl-2-butanol, 3,3-dimethyl-1-butanol, 3,3-dimethyl-2-butanol, 2-ethyl-1-butanol, and 2,2-dimethylbutanol; heptanol, such as 1-heptanol, 2-heptanol, 3-heptanol,2-methyl-1-hexanol, 2-methyl-1-hexanol, 2-methyl-2-hexanol, 2-methyl-3-hexanol, 5-methyl-2-hexanol, 3-ethyl-3-pentanol, 2,2-dimethyl-3-pentanol, 2,3-dimethyl-3-pentanol, 2,4-dimethyl-3-pentanol, 4,4-dimethyl-2-pentanol,3-methyl-1-hexanol, 4-methyl-1-hexanol, 5-methyl-1-hexanol, and 2-ethylpentanol; octanol, such as 1-octanol, 2-octanol, 3-octanol, 4-methyl-3-heptanol, 6-methyl-2-heptanol, 2-ethyl-1-hexanol, 2-propyl-1-pentanol, 2,4,4-trimethyl -1-pentanol, 3,5-dimethyl-1-hexanol, 2-methyl-1-heptanol, and 2,2-dimethyl-1-hexanol; nonanol, such as 1-nonanol, 2-nonanol, 3,5,5-trimethyl-1-hexanol, 2,6-dimethyl-4-heptanol, 3-ethyl-2,2-dimethyl-3-pentanol, and 5-methyloctanol; decanol, such as 1-decanol, 2-decanol, 4-decano3,7-dimethyl-1-octanol, and 2,4,6-trimethylheptanol; undecanol; dodecanol; tridecanol; tetradecanol; pentadecanol; hexadecanol; heptadecanol; octadecanol, such as stearyl alcohol; nonadecanol; eicosanol; heneicosanol; tricosanol; and tetracosanol.

Examples of the monohydric alkenyl alcohols may include ethenol, propenol, butenol, hexenol, octenol, decenol, dodecenol, or octadecenol, such as oleyl alcohol.

Examples of the monohydric (alkyl)cycloalkyl alcohols may include cyclopentanol, cyclohexanol, cycloheptanol, methylcyclopentanol, methylcyclohexanol, butylcyclohexanol, dimethylcyclohexanol, cyclopentylmethanol, cyclohexylmethanol, cyclohexylethanol, such as 1-cyclohexylethanol and 2-cyclohexylethanol, cyclohexylpropanol, such as 3-cyclohexylpropanol, cyclohexylbutanol, such as 4-cyclohexylbutanol, butylcyclohexanol, and 3,3,5,5-tetramethylcyclohexanol.

Examples of the (alkyl)aryl alcohol may include phenyl alcohol, methylphenyl alcohol, such as o-cresol, m-cresol, and p-cresol, creosol, ethylphenyl alcohol, propylphenyl alcohol, butylphenyl alcohol, butylmethylphenyl alcohol, such as 3-methyl-6-tert-butylphenyl alcohol, dimethylphenyl alcohol, diethylphenyl alcohol, dibutylphenyl alcohol, such as 2,6-di-tert-butylphenyl alcohol and 2,4-di-tert-butylphenyl alcohol, dibutylmethylphenyl alcohol, such as 2,6-di-tert-butyl-4-methylphenyl alcohol, dibutylethylphenyl alcohol, such as 2,6-di-tert-butyl-4-ethylphenyl alcohol, tributylphenyl alcohol, such as 2,4,6-tri-tert-butyl-4-butylphenyl alcohol, naphthol, such as α-naphthol and β-naphthol, and dibutylnaphthol, such as 2,4-di-tert-butyl-α-naphthol.

The monohydric alcohols may preferably be straight or branched C12-C18 alkyl alcohols, such as oleyl alcohol or stearyl alcohol, for enhanced reduction in friction between the DLC contact surfaces, and for low volatility and achievement of friction reducing effect even under high temperature conditions, for example, in engines.

The dihydric alcohol has two hydroxyl groups in its molecule, and may be, for example, C2-C40 alkyl- or alkenyldiol having a straight or branched alkyl or alkenyl group with the double bond in the alkenyl group at an arbitrary position; (alkyl)cycloalkanediol having a straight or branched alkyl group with alkyl and hydroxyl groups substituted at arbitrary positions; C2-C40 dihydric (alkyl)aryl alcohol having a straight or branched alkyl group with alkyl and hydroxyl groups substituted at arbitrary positions; a condensate of p-tert-butylphenol and formaldehyde; a condensate of p-tert-butylphenol and acetaldehyde; and a mixture of two or more of these.

Examples of the alkyl- or alkenyldiol may include ethylene glycol, diethylene glycol, polyethylene glycol, propylene glycol, dipropylene glycol, polypropylene glycol, neopentyl glycol, 1,3-propanediol, 1,4-butanediol, 1,2-butanediol, 2-methyl-1,3-propanediol, 1,5-pentanediol, 1,6-hexanediol, 2-ethyl-2-methyl-1,3-propanediol, 2-methyl-2,4-pentanediol, 1,7-heptanediol, 2-methyl-2-propyl-1,3-propanediol, 2,2-diethyl-1,3-propanediol, 1,8-octanediol, 1,9-nonanediol, 2-butyl-2-ethyl-1,3-propanediol, 1,10-decanediol, 1,11-undecanediol, 1,12-dodecanediol, 1,13-tridecanediol, 1,14-tetradecanediol, 1,15-heptadecanediol, 1,16-hexadecanediol, 1,17-heptadecanediol, 1,18-octadecanediol, 1,19-nonadecanediol, and 1,20-icosadecanediol.

Examples of the (alkyl)cycloalkanediol may include cyclohexanediol and methylcyclohexanediol.

Examples of the dihydric (alkyl)aryl alcohol may include benzenediol, such as catechol; methylbenzenediol; ethylbenzenediol; butylbenzenediol, such as p-tert-butylcatechol; dibutylbenzenediol, such as 4,6-di-tert-butyl resorcin; 4,4'-thiobis(3-methyl-6-tert-butylphenol), 4,4'-butylidenebis(3-methyl-6-tert-butylphenol), 2,2'-methylenebis(4-methyl-6-tert-butylphenol), 2,2'-thiobis(4,6-di-tert-butyl resorcin), 2,2'-methylenebis(4-ethyl-6-tert-butylphenol), 4,4'-methylenebis(2,6-di-tert-butylphenol), 2,2'-(3,5-di-tert-butyl-4-hydroxy)propane, and 4,4'-cyclohexylidenebis(2,6-di-tert-butylphenol).

The dihydric alcohol may preferably be ethylene glycol, neopentyl glycol, 1,6-hexanediol, 2-methyl-2,4-pentanediol, 2-ethyl-2-methyl-1,3-propanediol, 1,7-heptanediol, 1,8-octanediol, 1,9-nonanediol, 1,10-decanediol, 1,11-undecanediol, or 1,12-dodecanediol, for enhanced reduction in friction between the DLC contact surfaces. Hindered alcohols having a high molecular weight of not lower than 300, preferably not lower than 400, such as 2,6-di-tert-butyl-4-(3,5-di-tert-butyl-4-(3,5-di-tert-butyl-4-hydroxybenzyl)phenyl alcohol, are preferred for their low volatility, excellent heat resistance, and ability to exhibit friction reducing effect, even under high temperature conditions in engines or the like, and for their ability to give superior oxidation stability.

The trihydric or higher alcohol has three or more hydroxyl groups in its molecule, and usually trihydric to decahydric alcohols, preferably trihydric to hexahydric alcohols are used. Examples of these polyhydric alcohols may include glycerin; trimethylolalkane, such as trimethylolethane, trimethylolpropane, and trimethylolbutane; erythritol; pentaerythritol; 1,2,4-butanetriol; 1,3,5-pentanetriol; 1,2,6-hexanetriol; 1,2,3,4-butanetetrol; sorbitol; adonitol; arabitol; xylitol; mannitol; and polymers or condensates thereof.

Examples of the polymers or condensates may include dimers to octamers of glycerin, such as diglycerin, triglycerin, and tetraglycerin; dimers to octamers of trimethylolpropane, such as ditrimethylolpropane; dimers to tetramers of pentaerythritol, such as dipentaerythritol; sorbitan; intramolecular condensation compounds, such as sorbitol-glycerin condensation products; intermolecular condensation compounds; or self-condensation compounds.

As the trihydric or higher alcohols, sugars may also be used, such as xylose, arabitol, ribose, rhamnose, glucose, fructose, mannose, sorbose, cellobiose, mantose, isomaltose, trehalose, or sucrose.

The trihydric or higher alcohols may preferably be trihydric to hexahydric alcohols, such as glycerin; trimethylolalkane, including trimethylolethane, trimethylolpropane, and trimethylolbutane; pentaerythritol; 1,2,4-butanetriol; 1,3,5-pentanetriol; 1,2,6-hexanetriol; 1,2,3,4-butanetetrol; sorbitol; sorbitan; sorbitol-glycerin condensation products; adonitol; arabitol; xylitol; or mannitol; or mixtures thereof. Among these, glycerin, trimethylolethane, trimethylolpropane, pentaerythritol, sorbitan, and mixtures thereof are more preferred, and polyhydric alcohols having an oxygen content of not less than 20%, preferably not less than 30%, more preferably not less than 40%, are particularly preferred. Incidentally, polyhydric alcohols higher than hexahydric alcohols increase viscosity.

The carboxylic acids may be compounds having one or more carboxyl groups, such as aliphatic monocarboxylic acids, aliphatic polycarboxylic acids, carbocyclic carboxylic acids, heterocyclic carboxylic acids, or mixtures of two or more of these.

Examples of the aliphatic monocarboxylic acids may include C1-C40 saturated aliphatic monocarboxylic acids having a straight or branched saturated aliphatic group, and C2-C40 unsaturated aliphatic monocarboxylic acids having a straight or branched unsaturated aliphatic group, with an unsaturated bond at an arbitrary position.

Examples of the saturated aliphatic monocarboxylic acids may include methanoic acid; ethanoic acid (acetic acid); propanoic acid (propionic acid); butanoic acid, such as butyric acid and isobutyric acid; pentanoic acid, such as valeric acid, isovaleric acid, and pivalic acid; hexanoic acid, such as capronic acid; heptanoic acid; octanoic acid, such as caprylic acid; nonanoic acid, such as pelargonic acid; decanoic acid; undecanoic acid; dodecanoic acid, such as lauric acid; tridecanoic acid; tetradecanoic acid, such as myristic acid; pentadecanoic acid; hexadecanoic acid, such as palmitic acid; heptadecanoic acid; octadecanoic acid, such as stearic acid; nonadecanoic acid; icosanoic acid; henicosanoic acid; docosanoic acid; tricosanoic acid; tetracosanoic acid; pentacosanoic acid; hexacosanoic acid; heptacosanoic acid; octacosanoic acid; nonacosanoic acid; and triacontanoic acid.

Examples of the unsaturated aliphatic monocarboxylic acids may include propenoic acid, such as acrylic acid; propionic acid, such as propiolic acid; butenoic acid, such as methacrylic acid, crotonic acid, and isocrotonic acid; pentenoic acid; hexenoic acid; heptenoic acid; octenoic acid; nonenoic acid; decenoic acid; undecenoic acid; dodecenoic acid; tridecenoic acid; tetradecenoic acid; pentadecenoic acid; hexadecenoic acid; heptadecenoic acid; octadecenoic acid, such as oleic acid; nonadecenoic acid; icosenoic acid; henicosenoic acid; docosenoic acid; tricosenoic acid; tetracosenoic acid; pentacosenoic acid; hexacosenoic acid; heptacosenoic acid; octacosenoic acid; nonacosenoic acid; and triacontenoic acid.

Examples of the aliphatic polycarboxylic acid may include C2-C40 saturated or unsaturated aliphatic dicarboxylic acids having a straight or branched saturated or unsaturated aliphatic group with an unsaturated bond at an arbitrary position, saturated or unsaturated aliphatic tricarboxylic acids having a straight or branched saturated or unsaturated aliphatic group with an unsaturated bond at an arbitrary position, and saturated or unsaturated aliphatic tetracarboxylic acids having a straight or branched saturated or unsaturated aliphatic group with an unsaturated bond at an arbitrary position.

Examples of the aliphatic dicarboxylic acid may include ethanedioic acid (oxalic acid); propanedioic acid, such as malonic acid; butanedioic acid, such as succinic acid and methylmalonic acid; pentanedioic acid, such as glutanic acid and ethylmalonic acid; hexanedioic acid, such as adipic acid; heptanedioic acid, such as pimelic acid; octanedioic acid, such as spelic acid; nonanedioic acid, such as azelaic acid; decanedioic acid, such as sebacic acid; propenedioic acid; butenedioic acid, such as maleic acid and fumaric acid; pentenedioic acid, such as citraconic acid and mesaconic acid; hexenedioic acid; heptenedioic acid; octenedioic acid; nonenedioic acid; and decenedioic acid.

Examples of the aliphatic tricarboxylic acid may include propanetricarboxylic acid, butanetricarboxylic acid, pentanetricarboxylic acid, hexanetricarboxylic acid, heptanetricarboxylic acid, octanetricarboxylic acid, nonanetricarboxylic acid, and decanetricarboxylic acid.

The carbocyclic carboxylic acids may be C3-C40 mono-, di-, tri-, or tetracarboxylic acids having a naphthene ring, wherein alkyl and alkenyl groups, if contained, may be straight or branched, the position of a double bond is arbitrary, and the number and position of substitution are arbitrary; or C7-C40 mono-, di-, tri-, or tetracarboxylic acids having an aryl group, such as C7-C40 aromatic monocarboxylic acids, wherein alkyl and alkenyl groups, if contained, may be straight or branched, the position of a double bond is arbitrary, and the number and position of substitution are arbitrary.

Examples of the mono-, di-, tri-, or tetracarboxylic acid having a naphthene ring may include cyclohexane monocarboxylic acid, methylcyclohexane monocarboxylic acid, ethylcyclohexane monocarboxylic acid, propylcyclohexane monocarboxylic acid, butylcyclohexane monocarboxylic acid, pentylcyclohexane monocarboxylic acid, hexylcyclohexane monocarboxylic acid, heptylcyclohexane monocarboxylic acid, octylcyclohexane monocarboxylic acid, cycloheptane monocarboxylic acid, cyclooctane monocarboxylic acid, and trimethylcyclopentane dicarboxylic acid, such as camphoric acid.

Examples of the mono-, di-, tri-, or tetracarboxylic acid having an aryl group may include benzenecarboxylic acid (benzoic acid); methylbenzenecarboxylic acid, such as toluic acid; ethylbenzenecarboxylic acid; propylbenzenecarboxylic acid; benzenedicarboxylic acid, such as phthalic acid, isophthalic acid, and terephthalic acid; benzenetricarboxylic acid, such as trimellitic acid; benzenetetracarboxylic acid, such as pyromellitic acid; naphthalenecarboxylic acid, such as naphthoic acid; phenylpropanic acid, such as hydratropic acid; phenylpropenic acid, such as atropic acid and cinnamic acid; salicylic acid; and alkylsalicylic acid having one or more C1-C30 alkyl groups.

The heterocyclic carboxylic acids have one or more carboxyl groups in its molecule, and may be, for example, C5-C40 heterocyclic carboxylic acids, such as furancarboxylic acid, thiophenecarboxylic acid, pyridine carboxylic acid, including nicotinic acid and isonicotinic acid.

The esters are oxygen-containing organic compounds having one or more ester bonds, and may be, for example, esters of aliphatic monocarboxylic acids, esters of aliphatic polycarboxylic acids, esters of carbocyclic carboxylic acids, esters of heterocyclic carboxylic acids, or mixtures of two or more of these. The esters may be complete esters wherein all the hydroxyl or carboxyl groups in the esters are esterified, or partial esters wherein some of the hydroxyl or carboxyl groups remain intact.

The esters of aliphatic monocarboxylic acids may be esters of one or more compounds selected from the group consisting of the aliphatic monocarboxylic acids mentioned above, and one or more compounds selected from the group consisting of the mono-, di-, or trihydric, or higher alcohols mentioned above. Preferred examples of such esters may include glycerin monooleate, glycerin dioleate, glycerin trioleate, sorbitan monooleate, and sorbitan dioleate.

The esters of aliphatic polycarboxylic acids may be esters of one or more compounds selected from the group consisting of the aliphatic polycarboxylic acids mentioned above, and one or more compounds selected from the group consisting of the mono-, di-, or trihydric, or higher alcohols mentioned above. Preferred examples of such esters may include diesters of one or more polycarboxylic acids selected from the group consisting of C2-C40, preferably C4-C18, more preferably C6-C12 dicarboxylic acids, and one or more compounds selected from the group consisting of C4-C40, preferably C4-C18, more preferably C6-C14 monohydric alcohols, such as dibutyl maleate, ditridecyl glutarate, di-2-ethylhexyl adipate, diisodecyl adipate, ditridecyl adipate, or di-2-ethylhexyl sebacate; copolymers of these diesters, such as dibutyl maleate, and C4-C16 poly-α-olefins; and esters of α-olefin-acetic anhydride addition products and C1-C40 alcohols.

The esters of carbocyclic carboxylic acids maybe esters of one or more compounds selected from the group consisting of the carbocyclic carboxylic acids mentioned above, and one or more compounds selected from the group consisting of the mono-, di-, or trihydric, or higher alcohols mentioned above. Preferred examples of such esters may include aromatic carboxylic esters, such as phthalic esters, trimellitic esters, pyromellitic esters, and salicylic esters.

The esters of heterocyclic carboxylic acids may be esters of one or more compounds selected from the group consisting of the heterocyclic carboxylic acids mentioned above, and one or more compounds selected from the group consisting of the mono-, di-, or trihydric, or higher alcohols mentioned above.

The ethers are oxygen-containing organic compounds having one or more ether bonds, and may be saturated or unsaturated aliphatic ethers, aromatic ethers, cyclic ethers, ethers of polyhydric alcohols, and mixtures of two or more of these.

Examples of the saturated or unsaturated aliphatic ethers may include C1-C40 saturated or unsaturated aliphatic ethers, such as dimethyl ether, diethyl ether, di-n-propyl ether, diisopropyl ether, dibutyl ether, diisobutyl ether, di-n-amyl ether, dihexyl ether, diheptyl ether, dioctyl ether, dinonyl ether, didecyl ether, diundecyl ether, didodecyl ether, ditridecyl ether, ditetradecyl ether, dipentadecyl ether, dihexadecyl ether, diheptadecyl ether, dioctadecyl ether, dinonadecyl ether, diicosyl ether, methylethyl ether, methyl-n-propyl ether, methylisopropyl ether, methylisobutyl ether, methyl-tert-butyl ether, methyl-n-amyl ether, methylisoamyl ether, ethyl-n -propyl ether, ethylisopropyl ether, ethylisobutyl ether, ethyl-tert-butyl ether, ethyl-n-amyl ether, ethylisoamyl ether, divinyl ether, diallyl ether, methylvinyl ether, methylallyl ether, ethylvinyl ether, and ethylallyl ether. These saturated or unsaturated aliphatic group may either be straight or branched, and the position of an unsaturated bond may be arbitrary.

Examples of the aromatic ethers may include anisole, phenetole, phenyl ether, benzyl ether, phenylbenzyl ether, α-naphthyl ether, β-naphthyl ether, polyphenyl ether, and perfluoro ether. These compounds may have a straight or branched, saturated or unsaturated aliphatic group, the position of an unsaturated bond is arbitrary, and the position and number of substitution are arbitrary. These compounds are preferably in the liquid form upon use, preferably in the liquid form at room temperature.

Examples of the cyclic ethers may include C2-C40 cyclic ethers, such as ethylene oxide, propylene oxide, trimethylene oxide, tetrahydrofuran, tetrahydropyran, dioxane, and glycidyl ether. These compounds may have a straight or branched, saturated or unsaturated aliphatic group, a carbocyclic ring, or a carbocyclic ring having a saturated or unsaturated aliphatic group, the position of an unsaturated bond is arbitrary, and the position and number of substitution are arbitrary.

The ethers of polyhydric alcohols are ethers of one or more polyhydric alcohols selected from the group consisting of the dihydric, trihydric, or higher alcohols mentioned above, and one or more monohydric alcohols selected from the group consisting of the monohydric alcohols mentioned above. The ethers may be complete ethers wherein all the hydroxyl groups in the polyhydric alcohol are etherified, or partial ethers wherein some of the hydroxyl groups remain intact. For giving lower friction property, partial ethers are more preferred.

The ketones are oxygen-containing organic compounds having one or more carbonyl bonds, and may be saturated or unsaturated aliphatic ketones, carbocyclic ketones, heterocyclic ketones, ketone alcohols, ketonic acids, or mixtures of two or more of these.

Examples of the saturated or unsaturated aliphatic ketones may include C1-C40 saturated or unsaturated aliphatic ketones, such as acetone, methylethyl ketone, methylpropyl ketone, methylisopropyl ketone, methylbutyl ketone, methylisobutyl ketone, pinacolone, diethyl ketone, butyrone, diisopropyl ketone, methylvinyl ketone, mesityl oxide, and methylbutenone. These compounds may have a straight or branched, saturated or unsaturated aliphatic group, and the position of an unsaturated bond is arbitrary.

Examples of the carbocyclic ketones may include C1-C40 carbocyclic ketones, such as cyclobutanone, cyclopentanone, cyclohexanone, acetophenone, propiophenone, butyrophenone, valerophenone, benzophenone, dibenzyl ketone, and 2-acetonaphthone. These compounds may have a straight or branched, saturated or unsaturated aliphatic group, the position of an unsaturated bond is arbitrary, and the position and number of substitution are arbitrary.

Examples of the heterocyclic ketones may include C1-C40 carbocyclic ketones, such as acetothienone and 2-acetofuron. These compounds may have a straight or branched, saturated or unsaturated aliphatic group, the position of an unsaturated bond is arbitrary, and the position and number of substitution are arbitrary.

Examples of the ketone alcohols may include C1-C40 ketone alcohols, such as acetol, acetoin, acetoethyl alcohol, diacetone alcohol, phenacyl alcohol, and benzoin. These compounds may have acarbocyclic or heterocyclic ring, or a carbocyclic or heterocyclic ring with a straight or branched, saturated or unsaturated aliphatic group, the position of an unsaturated bond is arbitrary, and the position and number of substitution are arbitrary.

Examples of the ketonic acids may include C1-C40 ketonic acids, such as α-ketonic acids including pyruvic acid, benzoylformic acid, and phenylpyruvic acid; β-ketonic acids including acetoacetic acid, propionylacetic acid, and benzoylacetic acid; and γ-ketonic acids including levulinic acid and β-benzoylpropionic acid.

The aldehydes are oxygen-containing organic compounds having one or more aldehyde groups, and may be saturated or unsaturated aliphaticaldehydes, carbocyclic aldehydes, heterocyclic aldehydes, and mixtures of two or more of these.

Examples of the saturated or unsaturated aliphatic aldehydes may include C1-C40 saturated or unsaturated aliphatic aldehydes, such as formaldehyde, acetoaldehyde, propionaldehyde, butylaldehyde, isobutylaldehyde, valeraldehyde, isovaleraldehyde, pivalinaldehyde, capronaldehyde, pelargonaldehyde, caprinaldehyde, undecylaldehyde, laurinaldehyde, tridecylaldehyde, myristinaldehyde, pentadecylaldehyde, palmitinaldehyde, margarinaldehyde, stearinaldehyde, acrolein, crotonaldehyde, propiolaldehyde, glyoxal, and succindialdehyde. These compounds may have a straight or branched, saturated or unsaturated aliphatic group, and the position of an unsaturated bond is arbitrary.

Examples of the carbocyclic aldehydes may include C1-C40 carbocyclic aldehydes, such as benzaldehyde, o-tolualdehyde, m-tolualdehyde, p-tolualdehyde, salicylaldehyde, cinnamaldehyde, α-naphthaldehyde, and β-naphthaldehyde. These compounds may have a straight or branched, saturated or unsaturated aliphatic group, the position of an unsaturated bond is arbitrary, and the position and number of substitution are arbitrary.

Examples of the heterocyclic aldehydes may include C1-C40 heterocyclic aldehydes, such as furfural. These compounds may have a straight or branched, saturated or unsaturated aliphatic group, the position of an unsaturated bond is arbitrary, and the position and number of substitution are arbitrary.

The carbonates are oxygen-containing organic compounds having one or more carbonate bonds, and may be carbonates having a saturated or unsaturated C1-C40 aliphatic group, a carbocyclic ring, a carbocyclic ring having a saturated or unsaturated aliphatic group, or a saturated or unsaturated aliphatic group having a carbocyclic ring, such as dimethyl carbonate, diethyl carbonate, di-n-propyl carbonate, diisopropyl carbonate, di-n-butyl carbonate, diisobutyl carbonate, di-tert-butyl carbonate, dipentyl carbonate, dihexyl carbonate, diheptyl carbonate, dioctyl carbonate, dinonyl carbonate, didecyl carbonate, diundecyl carbonate, didodecyl carbonate, ditridecyl carbonate, ditetradecyl carbonate, dipentadecyl carbonate, dihexadecyl carbonate, diheptadecyl carbonate, dioctadecyl carbonate, or diphenyl carbonate. These compounds may have a straight or branched, saturated or unsaturated aliphatic group, the position of an unsaturated bond is arbitrary, and the position and number of substitution are arbitrary.

Further, hydroxy(poly)oxyalkylene carbonates, wherein alkylene oxide is added to these carbonates, may also be used.

The above alcohols may be represented by the formula R—(OH)n, the carboxylic acids by the formula R—(COOH)n, the esters by the formula R—(COO—R')n, the ethers by the formula R—(O—R')n, the ketones by the formula R—(CO—R')n, the aldehydes by the formula R—(CHO)n, and the carbonates by the formula R—(O—COO—R')n.

R and R' in the above formulae each independently stands for a hydrocarbon group, such as an alkyl, alkenyl, alkylene, cycloalkyl, alkylcycloalkyl, aryl, alkylaryl, or aryl alkyl group, or a hydrocarbon group from which one or more hydrogen atoms are removed. The hydrocarbon group may optionally have one or more groups or bonds selected from the group consisting of a hydroxyl group, a carboxyl group, a carbonyl group, an ester bond, and an ether bond, or may optionally contain an element other than carbon, hydrogen, and oxygen, such as nitrogen, sulfur, a heterocyclic compound, halogen, for example, fluorine or chlorine, phosphorus, boron, metal, or the like.

The number of carbons in the hydrocarbon group is not particularly limited, and is preferably 1 to 40, more preferably 2 to 30, most preferably 3 to 20.

Examples of the alkyl group may include C1-C40 alkyl groups, such as methyl, ethyl, n-propyl, isopropyl, n-butyl, isobutyl, sec-butyl, tert-butyl, straight or branched pentyl, straight or branched heptyl, straight or branched octyl, straight or branched nonyl, straight or branched decyl, straight or branched undecyl, straight or branched dodecyl, straight or branched tridecyl, straight or branched tetradecyl, straight or branched pentadecyl, straight or branched hexadecyl, straight or branched heptadecyl, straight or branched octadecyl, straight or branched nonadecyl, straight or branched icosyl, straight or branched henicosyl, straight or branched docosyl, straight or branched tricosyl, and straight or branched tetracosyl groups. The alkyl group is preferably a C2-C30, more preferably C3-C20 alkyl group.

Examples of the alkenyl group may include C2-C40 alkenyl groups, such as vinyl, straight or branched propenyl, straight or branched butenyl, straight or branched pentenyl, straight or branched hexenyl, straight or branched heptenyl, straight or branched octenyl, straight or branched nonenyl, straight or branched decenyl, straight or branched undecenyl, straight or branched dodecenyl, straight or branched tridecenyl, straight or branched tetradecenyl, straight or branched pentadecenyl, straight or branched hexadecenyl, straight or branched heptadecenyl, straight or branched octadecenyl, straight or branched nonadecenyl, straight or branched icosenyl, straight or branched henicosenyl, straight or branched docosenyl, straight or branched tricosenyl, and straight or branched tetracosenyl groups. The alkenyl group may preferably be a C2-C30, more preferably C3-C20 alkenyl group.

Examples of the cycloalkyl group may include C3-C40 cycloalkyl groups, such as cyclopentyl, cyclohexyl, cycloheptyl, and cyclooctyl groups. The cycloalkyl group may preferably be a C3-C20, more preferably C5-C8 cycloalkyl group.

Examples of the alkylcycloalkyl group may include C4-C40 alkylcycloalkyl group, such as methylcyclopentyl, dimethylcyclopentyl, methylethylcyclopentyl, diethylcyclopentyl, methylcyclohexyl, dimethylcyclohexyl, methylethylcyclohexyl, diethylcyclohexyl, methylcycloheptyl, dimethylcycloheptyl, methylethylcycloheptyl, and diethylcycloheptyl groups. The alkylcycloalkyl group may preferably be a C5-C20, more preferably C6-C12 alkylcycloalkyl group, and includes all possible structural isomers.

Examples of the aryl group may include C6-C20 aryl groups, such as phenyl and naphthyl groups. More preferably, the aryl group may be a C6-C10 aryl group.

Examples of the alkylaryl group may include 1-substituted phenyl groups, such as tolyl, ethylphenyl, straight or branched propylphenyl, straight or branched butylphenyl, straight or branched pentylphenyl, straight or branched hexylphenyl, straight or branched heptylphenyl, straight or branched octylphenyl, straight or branched nonylphenyl, straight or branched decylphenyl, straight or branched undecylphenyl, and straight or branched dodecylphenyl groups; and aryl groups having two or more same or different, straight or branched alkyl groups, such as xylyl, diethylphenyl, dipropylphenyl, 2-methyl-6-tert-butylphenyl, 2,6-di-tert-butyl-4-methylphenyl, and 2,6-di-tert-butyl-4-(3,5-di-tert-butyl-4-benzyl)phenyl groups. The alkylaryl group may be a C7-C40, preferably C7-C20, more preferably C7-C12 alkylaryl group. The alkyl group may optionally have an aryl, alkylaryl, or arylalkyl group, and includes all possible structural isomers.

Examples of the arylalkyl group may include C7-C40 arylalkyl groups, such as benzyl, phenylethyl, phenylpropyl, phenylbutyl, phenylpentyl, and phenylhexyl groups. The arylalkyl group may preferably be a C7-C20, more preferably C7-C12 arylalkyl group, and includes all possible structural isomers.

The oxygen-containing organic compounds may also be derivatives of the compounds mentioned above. Such derivatives may include, but not limited to, the compounds obtained by reacting, with the oxygen-containing organic compound, at least one of nitrogen-containing compounds, sulfur, sulfur-containing compounds, boron-containing compounds, halogens, halogen compounds, metal elements, organic or inorganic metal-containing compounds, and alkylene oxides. For example, compounds obtained by sulfuration of, or halogenation, such as fluorination or chlorination, of at least one compound selected from the group consisting of the above alcohols, carboxylic acids, esters, ethers, ketones, aldehydes, and carbonates; reaction products of at least one compound selected from the above group with sulfuric acid, nitric acid, boric acid, or phosphoric acid, esters or metal salts of these acids; alkylene oxide addition products obtained by reaction of at least one compound selected from the above group with metal, metal-containing compounds, or alkylene oxides; or reaction products of at least one compound selected from the above group with amine compounds, may be used.

Among these, reaction products of at least one compound selected from the group consisting of the alcohols, carboxylic acids, aldehydes, and derivatives thereof, with amine compounds, such as Mannich reaction products; acrylation products of at least one compound selected from the above group; and amides of at least one compound selected from the above group, are preferably used.

The amine compounds may be ammonia, monoamine, diamine, or polyamine. Specific examples of the amine compounds may include ammonia; alkylamines having a straight or branched C1-C30 alkyl group, such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, stearylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a straight or branched C2-C30 alkenyl group, such as ethenylamine, propenylamine, butenylamine, octenylamine, and oleylamine; alkanolamines having a straight or branched C1-C30 alkanol group, such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; straight or branched C1-C30 alkylenediamine, such as methylenediamine, ethylenediamine, propylenediamine, and butylenediamine; polyamines, such as diethylenetriamine, triethylenetetramine, tetraethylenepentamine, and pentaethylenehexamine; the above monoamines, diamines, polyamines having a C8-C20 alkyl or alkenyl group, such as undecyldiethylamine, undecyldiethanolamine, dodecyldipropanolamine, oleyldiethanolamine, oleylpropylenediamine, and stearyltetraethylenepentamine; heterocyclic compounds, such as N-hydroxyethyloleylimidazoline; alkylene oxide addition products of these compounds; and mixtures thereof.

Among these nitrogen compounds, aliphatic amines having C10-C20alkyl or alkenyl group, (alkyl or alkenyl group may be straight or branched chain), such as decylamine, dodecylamine, tridecylamine, heptadecylamine, octadecylamine, oleylamine, and strearylamine, are preferred.

Among the above-mentioned derivatives of the oxygen-containing organic compounds, amides of the C8-C20 carboxylic acids from the aliphatic monocarboxylic acids and the amine compounds, such as oleamide, are particularly preferred.

The oxygen-containing organic compounds have been discussed. Among the listed compounds, those having a hydroxyl group are preferred for giving superior friction reducing effect. Further, an alcoholic hydroxyl group is more preferred than a hydroxyl-group directly bonded to a carbonyl group, such as a carboxyl group, for giving still superior friction reducing effect. The number of such hydroxyl groups in the compound is not particularly limited, but the compound preferably contains as many hydroxyl groups as possible for superior friction reducing effect. However, when the compound is used with a medium, such as the lubricant base oil, the number of the hydroxyl groups may be restricted in view of the solubility.

The aliphatic amines may be those having a straight or branched, C6-C30, preferably C8-C24, more preferably C10-C20, aliphatic hydrocarbon group. If the number of carbon atoms is outside the range of 6 to 30, sufficient friction reducing effect may not be achieved. Other hydrocarbon groups may optionally be contained, as long as the straight or branched aliphatic hydrocarbon groups within the above-mentioned range are contained.

Examples of the straight or branched C6-C30 aliphatic hydrocarbon groups may include alkyl groups, such as hexyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, docosyl, tricosyl, tetracosyl, pentacosyl, hexacosyl, heptacosyl, octacosyl, nonacosyl, and triacontyl groups; and alkenyl groups, such ashexenyl, heptenyl, octenyl, nonenyl, decenyl, undecenyl, dodecenyl, tridecenyl, tetradecenyl, pentadecenyl, hexadecenyl, heptadecenyl, octadecenyl, nonadecenyl, icosenyl, henicosenyl, docosenyl, tricosenyl, tetracosenyl, pentacosenyl, hexacosenyl, heptacosenyl, octacosenyl, nonacosenyl, and triacontenyl groups.

The above alkyl and alkenyl groups may either be straight or branched, and the double bond in the alkenyl group may be at an arbitrary position.

The aliphatic amines may be various amine compounds, such as monoamines, polyamines, alkanolamines, or imidazoline compounds having the straight or branched C6-C30 aliphatic hydrocarbon group mentioned above, or derivatives thereof.

Examples of the monoamines may include laurylamine, lauryldiethylamine, palmitinamine, stearylamine, and oleylamine.

Examples of the polyamines may include stearyltetraethylenepentamine and oleylpropylenediamine.

Examples of the alkanolamines may include lauryldiethanolamine, dodecyldipropanolamine, and oleyldiethanolamine.

Examples of the nitrogen-containing heterocyclic compounds may include N-hydroxyethyloleylimidazoline.

The derivatives may be alkylene oxide addition products, acid modified compounds, or the like.

The alkylene oxide addition products may be compounds obtained by addition reaction of alkylene oxide to a nitrogen atom in the various amine compounds mentioned above. Examples of the alkylene oxide addition products may include N,N-dipolyoxyalkylene-N-alkyl- or alkenylamine obtained by addition reaction of alkylene oxide to a primary monoamine having a C6-C28 alkyl or alkenyl group, more specifically, N,N-dipolyoxyethylene-N-oleylamine.

The acid modified compounds may be obtained by reacting, to the above-mentioned various amines, the above carboxylic acids, preferably the aliphatic monocarboxylic acids, in particular C2-C30 aliphatic monocarboxylic acids, the above aliphatic polycarboxylic acids, in particular C2-C30 aliphatic polycarboxylic acids, including oxalic acid, or the above carbocyclic carboxylic acids, in particular C6-C30 carbocyclic carboxylic acids, including phthalic acid, trimellitic acid, or pyromellitic acid, to fully or partially neutralize or amidify the amino and/or imino groups.

In the lubricant of the present invention, it is preferred to add component (C) for further improving the friction reducing effect. The content of component (C) is not particularly limited, and is usually not more than 3.0 mass %, preferably 0.05 to 3.0 mass %, more preferably 0.1 to 2.0 mass %, most preferably 0.5 to 1.4 mass %, of the total amount of the lubricant.

Component (D), a metal detergent, may preferably be alkali metal or alkaline earth metal sulfonates, alkali metal or alkaline earth metal salicylates, alkali metal or alkaline earth metal phenates, alkali metal or alkaline earth metal carboxylates, alkali metal or alkaline earth metal naphthates, or mixtures of two or more of these.

The alkali metal may be, for example, sodium or potassium, and the alkaline earth metal may be, for example, calcium, magnesium, or barium. The metal of the metal detergent is preferably an alkaline earth metal, in particular, calcium.

Component (D) may be neutral, basic, or overbased, and any of these may be used. Neutral alkaline earth metal salicylate has particularly excellent friction reducing effect. Basic or overbased metal detergent may be, for example, a metal detergent containing calcium carbonate and/or calciumborate, and any of these may be used. However, a metal detergent containing calcium borate is preferred for its particularly superior friction reducing effect.

Preferred among these are sulfur-free metal detergents, such as alkali metal or alkaline earth metal salicylates, alkali metal or alkaline earth metal phenates (without sulfur crosslinking, for example, crosslinked with alkylene groups), or alkali metal or alkaline earth metal carboxylates, more preferably alkaline earth metal salicylates containing calcium carbonate and/or calcium borate, most preferably alkaline earth metal salicylates containing calcium borate.

Component (D) may have negative impact on the friction property. For minimizing such negative impact, neutral alkaline earth metal salicylates, or basic or overbased metal detergents containing calcium borate may preferably be used.

The total base number of metal detergent (D) is not particularly limited, and is usually 0 to 500 mgKOH/g, preferably 10 to 400 mgKOH/g. It is preferred to use either or both of the metal detergents of 10 to 150 mgKOH/g and 150 to 350 mgKOH/g.

In the lubricant of the present invention, metal detergent (D) may be added as desired for improving the detergency, such as sludge dispersibility. The content of component (D) is not particularly limited. For use in internal combustion engines, the content in terms of the metal elements, is usually not more than 1 mass %, preferably 0.01 to 1 mass %, more preferably not less than 0.05 mass % and the upper limit is usually not more than 0.3 mass %, particularly not more than 0.2 mass % of the total amount of the lubricant, for lowering sulfated ash.

Component (E), a phosphorus-based anti-wear agent, may be of any type, as long as it is an anti-wear agent containing phosphorus in its molecule.

Component (E) maybe, for example, phosphorus compounds, such as phosphites, phosphates, thiophosphites, thiophosphates, dithiophosphates, each having a C1-C30 hydrocarbon group, metal salts thereof, such as zinc salts thereof, or amine salts thereof.

The C1-C30 hydrocarbon group may preferably be a straight or branched C1-C30 alkyl group, a straight or branched C1-C30 alkenyl group, a C5-C13 cycloalkyl or straight or branched alkylcycloalkyl group, a C6-C18 aryl or straight or branched alkylaryl group, or C7-C19 arylalkyl group. The alkyl or alkenyl group may either be primary, secondary, or tertiary.

Examples of the C1-C30 hydrocarbon group may include alkylgroups, suchasmethyl, ethyl, propyl, butyl, pentyl, hexyl, heptyl, octyl, nonyl, decyl, undecyl, dodecyl, tridecyl, tetradecyl, pentadecyl, hexadecyl, heptadecyl, octadecyl, nonadecyl, icosyl, henicosyl, docosyl, tricosyl, and tetracosyl groups; alkenyl groups, such as propenyl, isopropenyl, butenyl, butadienyl, pentenyl, hexenyl, heptenyl, octenyl, nonenyl, decenyl, undecenyl, dodecenyl, tridecenyl, tetradecenyl, pentadecenyl, hexadecenyl, heptadecenyl, octadecenyl, such as oleyl, nonadecenyl, icosenyl, henicosenyl, docosenyl, tricosenyl, and tetracosenyl groups; cycloalkyl groups, such as cyclopentyl, cyclohexyl, and cycloheptyl groups; alkylcycloalkyl groups, such as methylcyclopentyl, dimethylcyclopentyl, ethylcyclopentyl, propylcyclopentyl, ethylmethylcyclopentyl, trimethylcyclopentyl, diethylcyclopentyl, ethyldimethylcyclopentyl, propylmethylcyclopentyl, propylethylcyclopentyl, dipropylcyclopentyl, propylethylmethylcyclopentyl, methylcyclohexyl, dimethylcyclohexyl, ethylcyclohexyl, propylcyclohexyl, ethylmethylcyclohexyl, trimethylcyclohexyl, diethylcyclohexyl, ethyldimethylcyclohexyl, propylmethylcyclohexyl, propylethylcyclohexyl, dipropylcyclohexyl, propylethylmethylcyclohexyl, methylcycloheptyl, dimethylcycloheptyl, ethylcycloheptyl, propylcycloheptyl, ethylmethylcycloheptyl, trimethylcycloheptyl, diethylcycloheptyl, ethyldimethylcycloheptyl, propylmethylcycloheptyl, propylethylcycloheptyl, dipropylcycloheptyl, and propylethylmethylcycloheptyl groups; aryl groups, such as phenyl and naphthyl groups; alkylaryl groups, such as tolyl, xylyl, ethylphenyl, propylphenyl, ethylmethylphenyl, trimethylphenyl, butylphenyl, propylmethylphenyl, diethylphenyl, ethyldimethylphenyl, tetramethylphenyl, pentylphenyl, hexylphenyl, heptylphenyl, octylphenyl, nonylphenyl, decylphenyl, undecylphenyl, and dodecylphenyl groups; arylalkyl groups, such as benzyl, methylbenzyl, dimethylbenzyl, phenethyl, methylphenethyl, and dimethylphenethyl groups.

The hydrocarbon group includes all conceivable straight and branched structures, and the position of the double bond in an alkenyl group, the position of an alkyl group bonded to a cycloalkyl group, the position of an alkyl group bonded to an aryl group, and the position of an aryl group bonded to an alkyl group, are all arbitrary. Further, the hydrocarbon group may have a (poly)alkylene oxide, such as (poly)ethylene oxide or (poly)propylene oxide.

The metal in the metal salt is not particularly limited, and may be, for example, an alkali metal, such as lithium, sodium, potassium, or cesium; an alkaline earth metal, such as calcium, magnesium, or barium; or a heavy metal, such as zinc, copper, iron, lead, nickel, silver, manganese, or molybdenum. Among these, alkaline earth metals, such as calcium and magnesium, and zinc are preferred, and zinc is most preferred.

The amine in the amine salt is not particularly limited, and may be, for example, ammonia, monoamine, diamine, or polyamine. Specific examples may include alkylamines having a C1-C30 alkyl group (either straight or branched), such as methylamine, ethylamine, propylamine, butylamine, pentylamine, hexylamine, heptylamine, octylamine, nonylamine, decylamine, undecylamine, dodecylamine, tridecylamine, tetradecylamine, pentadecylamine, hexadecylamine, heptadecylamine, octadecylamine, dimethylamine, diethylamine, dipropylamine, dibutylamine, dipentylamine, dihexylamine, diheptylamine, dioctylamine, dinonylamine, didecylamine, diundecylamine, didodecylamine, ditridecylamine, ditetradecylamine, dipentadecylamine, dihexadecylamine, diheptadecylamine, dioctadecylamine, methylethylamine, methylpropylamine, methylbutylamine, ethylpropylamine, ethylbutylamine, and propylbutylamine; alkenylamines having a C2-C30 alkenyl group (either straight or branched), such as ethenylamine, propenylamine, butenylamine, octenylamine, and oleylamine; alkanolamines having a C1-C30 alkanol group (either straight or branched), such as methanolamine, ethanolamine, propanolamine, butanolamine, pentanolamine, hexanolamine, heptanolamine, octanolamine, nonanolamine, methanolethanolamine, methanolpropanolamine, methanolbutanolamine, ethanolpropanolamine, ethanolbutanolamine, and propanolbutanolamine; alkylenediamines having a C1-C30 alkylene group, such as methylenediamine, ethylenediamine, propylenediamine, and butylenediamine; polyamines, such as diethylenetriamine, triethylenetetramine, tetraethylenepentamine, and pentaethylenehexamine; heterocyclic compounds including the above-mentioned monoamines, diamines, polyamines having a C8-C20 alkyl or alkenyl group, such as undecyldiethylamine, undecyldiethanolamine, dodecyldipropanolamine, oleyldiethanolamine, oleylpropylenediamine, and stearyltetraethylenepentamine, and N-hydroxyethyloleylimidazoline; alkylene oxide addition products thereof; mixtures thereof; and compounds, such as alkyl or alkenyl succinimides.

Among these amine compounds, aliphatic amines (either straight or branched) having a C10-C20 alkyl or alkenyl group, such as decylamine, dodecylamine, tridecylamine, heptadecylamine, octadecylamine, oleylamine, and stearylamine, are preferred.

Preferred examples of component (E) are dithiophosphoric acids having a primary, secondary, or tertiary alkyl group of usually C3-C24, preferably C4-C18, more preferably C4-C12, when a part of, or a principal part of a plurality of contact surfaces in a device or an apparatus are the DLC contact surfaces. In particular, zinc dithiophosphate having a C4-C12 primary alkyl group (primary type), and zinc dithiophosphate having a secondary alkyl group (secondary type) are preferred, and zinc dithiophosphate having a secondary alkyl group is more preferred.

When both the primary zinc dithiophosphate and the secondary zinc dithiophosphate are used as component (E), the ratio of the two are preferably such that usually not less than 50%, preferably not less than 60% by mass of component (E) is the secondary zinc dithiophosphate in terms of phosphorus. In the lubricant of the present invention, the zinc dithiophosphate is extremely useful.

Other preferable examples of component (E) may include sulfur-free phosphorus compounds, when a part of, a principal part of, or all of, in particular a principal part or all of a plurality of contact surfaces in a device or an apparatus are the DLC contact surfaces. Preferred examples may include phosphite monoesters, phosphite diesters, phosphite triesters, phosphate monoesters, phosphate diesters, and phosphate triesters, each having a C3-C24, preferably C4-C18, more preferably C4-C12, primary, secondary, or tertiary alkyl group; metal salts thereof; and amine salts thereof. Among these, phosphate esters, metal salts thereof, and amine salts thereof are preferred, and metal salts and amine salts (amine complexes) of phosphate monoesters and/or phosphate diesters are particularly preferred.

Component (E) may optionally be added to the lubricant of the present invention as desired, since this component provides superior anti-wear property and improved friction reducing effect when the contact surfaces are under severe motion. The content of component (E) is not particularly limited, and usually not more than 5 mass %, preferably 0.1 to 5 mass %, of the total amount of the lubricant. When the lubricant of the present invention is to be used in an internal combustion engine, the content of component (E) may usually be not more than 0.1 mass %, preferably 0.01 to 0.1 mass %, more preferably 0.06 to 0.08 mass % of the total amount of the lubricant, in terms of phosphorus elements.

Component (E) may have negative impact on the friction property. For minimizing such negative impact, sulfur-free, phosphorus-based anti-wear agents, which do not contain sulfur, may preferably be used.

The lubricant of the present invention and lubricant (L) mentioned above may optionally contain known additives for improving desired performance. For example, additives may be contained, selected from the group consisting of anti-wear agents other than component (E), ashless dispersants, anti-oxidants, viscosity index improvers, pour point depressants, friction modifiers other than the above, rust inhibitors, metal deactivators, surfactants, demulsifiers, seal swelling agents, foam inhibitors, coloring agents, and mixtures thereof.

The anti-wear agents other than component (E) and extreme pressure agents may be known agents, for example, sulfur-containing anti-wear agents and extreme pressure agents, such as sulfurized oils and fats, sulfuric esters, olefin sulfides, dithiocarbamates and derivatives thereof, and dithiophosphate derivatives. These sulfur-containing anti-wear agents may be contained preferably in a small amount, for example, not more than 0.1 mass % of the total amount of the lubricant in terms of sulfur elements, and more preferably the lubricant is free of these sulfur-containing anti-wear agents.

The ashless dispersant may be a known ashless dispersant used in lubricants. Preferred examples may include polybutenyl succinimide dispersants, polybutenyl benzylamine dispersants, polybutenylamine dispersants, and Mannich dispersants, wherein the polybutenyl group has a number average molecular weight of preferably 700 to 3500, more preferably 900 to 2500. The ashless dispersant may also be boron compound derivatives, carboxylic acid derivatives, or the like.

The content of the ashless dispersant, if any, is not particularly limited, and is usually 0.1 to 15 mass % of the total amount of the lubricant.

The anti-oxidant may be a known anti-oxidant used in lubricants. Preferred examples may include ashless anti-oxidants, such as phenol anti-oxidants and amine anti-oxidants; and metal-based anti-oxidants, such as molybdenum-based or copper-based anti-oxidants, and the use of a phenol anti-oxidant and/or an amine anti-oxidant is particularly preferred.

The content of the anti-oxidant, if any, is not particularly limited, and is usually 0.01 to 3 mass % of the total amount of the lubricant.

The viscosity index improver may be a so-called non-dispersant type viscosity index improver, such as a polymer of various methacrylic acids or a hydrogenation products thereof, or a copolymer thereof in an arbitrary combination and a hydrogenation product thereof; or a so-called dispersant type viscosity index improver further including copolymerized therewith various methacrylates having a nitrogen compound. Non-dispersant or dispersant type ethylene-α-olefin copolymers and hydrides thereof, polyisobutylene and hydrogenation products thereof, hydrogenated products of styrene-diene copolymers, styrene-maleic anhydride ester copolymers, polyalkylstyrene, and the like may also be used. The α-olefin may preferably be propylene, 1-butene, or 1-pentene, and more preferably polymethacrylate.

The molecular weight of the viscosity index improver should be selected in the light of shear stability. Specific examples of the number average molecular weight of the viscosity index improver may be usually 5000 to 1000000, preferably 100000 to 800000 for the dispersant or non-dispersant type polymethacrylate; and usually 800 to 5000 for polyisobutylene or hydrides thereof; and usually 800 to 300000, preferably 10000 to 200000 for ethylene-α-olefin copolymers and hydrides thereof. One or a combination of a plurality of kinds of the viscosity index improvers may be used, and a preferred content is usually 0.1 to 40.0 mass % of the total amount of the lubricant.

The pour point depressant may be a pour point depressant suitable for the lubricant base oil. For example, polymethacrylate-based pour point depressant may be used.

The other friction modifier may be molybdenum disulfide, or other known friction modifier.

The rust inhibitor may be, for example, alkylbenzene sulfonate, dinonylnaphthalene sulfonate, alkenylsuccinate, or polyhydric alcohol ester.

The demulsifier may be, for example, a polyalkylene glycol-based nonionic surfactant, such as polyoxyethylene alkyl ether, polyoxyethylene alkylphenyl ether, or polyoxyethylene alkylnaphthyl ether.

The metal deactivator maybe, for example, imidazoline, a pyrimidine derivative, benzotriazole, or thiadiazole.

The foam inhibitor may be, for example, silicon, fluorosilicon, or fluoroalkyl ether.

In the lubricant of the present invention, the content of the rust inhibitor and/or demulsifier, if any, is not particularly limited, and is usually 0.01 to 5 mass % of the total amount of the lubricant. The content of the metal deactivator, if any, is not particularly limited, and may suitably be selected from the range of usually 0.0005 to 1 mass % of the total amount of the lubricant.

In the system having the DLC contact surfaces according to the present invention, lubricant (L) may be interposed between the DLC contact surfaces or the non-DLC contact surfaces, by supplying lubricant (L) between the contact surfaces in a manner suitable for the type of the system, such as a sealed or circulating type, and operating the system.

The system of the present invention has a pair of relatively movable, facing DLC contact surfaces at least one of which is coated with a DLC film, and may be, for example, an internal combustion engine, such as a four- or two-cycle engine, and more specifically, an internal combustion engine having the DLC contact surfaces in at least one location in valve trains, pistons, piston rings, piston skirts, cylinder liners, connecting rods, crank shafts, bearings, roller bearings, metal gears, chains, belts, oil pumps, and the like. Further, drive transmission mechanisms, for example, a drive having gears or contact surfaces of a hard disk drive, and other systems having at least one pair of various DLC contact surfaces working under severe friction conditions and required to have low friction property, are also included.

In the system of the present invention, preferred examples of the valve trains in an internal combustion engine may include valve trains having contact surfaces composed of a disk-shaped shim or a lifter crown surface produced by forming a DLC film over a steel substrate, and a cam lobe made of a low alloy chilled cast iron, carburized steel, or thermal refining carbon steel, or a material of an arbitrary combination of these.

The method of lubricating a system according to the present invention may be practiced by lubricating the above mentioned pair of relatively movable, facing DLC contact surfaces at least one of which is coated with a DLC film, by supplying lubricant (L) therebetween. By supplying the lubricant of the present invention, i.e., lubricant (L), to lubricate the DLC contact surfaces, in particular, both the DLC contact surfaces and the non-DLC contact surfaces, the friction of the whole system having the contact surfaces may be reduced, and the low friction property may be maintained stably for a prolonged period of time.

EXAMPLES

The present invention will now be explained in more detail with reference to Examples and Comparative Examples, but the Examples do not intend to limit the present invention, which may be modified or improved in various ways.

Examples 1-9, Referential Example 1, and Comparative Example 1

A shim covered with a DLC film was prepared as a shim for a valve train in an engine for measuring engine motoring torque, which is an example of the DLC contact surfaces in a low friction motion system. The shim was prepared by grinding a SUJ2 heat treated material, and polishing with a wrapping tape into a predetermined surface roughness (Ra=0.2 μm or lower). Over the surface of the obtained shim, a DLC film of the a-C type was formed by CVD treatment to have a thickness of 1.1 μm, and polished with a wrapping tape in to the surface roughness (Ra) of 0.04 m. The surface hardness Hv of the shim was 1800.

(Preparation of Lubricant Composition)

Lubricants according to the present invention (Examples 1-9), a lubricant for comparison (Comparative Example 1), and a lubricant free of a sulfur-containing molybdenum complex for reference (Referential Example 1) were prepared as shown in Table 1.

In Table 1, base oil I is a severely hydrocracked mineral oil having a kinematic viscosity of 4.0 $mm^2/s$ at 100° C., a viscosity index of 125, an aromatic content of 1.0 mass %, and a sulfur content of 0.001 mass %. The sulfur-containing molybdenum complex is MoDTC containing 9.9 mass % Mo and a diluent oil. Friction modifier I is glycerin monooleate. Metal detergent I is overbased calcium salicylate containing calcium borate, having a total base number of 170 mgKOH/g and a calcium content of 6.8 mass %, whereas metal detergent II is overbased calcium salicylate containing calcium carbonate, having a total base number of 166 mgKOH/g and a calcium content of 6.2 mass %. Phosphorus-based anti-wear agent I is zinc dialkyldithiophosphate having a phosphorus content of 7.2 mass % and a secondary/primary ratio of 65/35 (by mass of phosphorus content), whereas phosphorus-based anti-wear agent II is zinc dialkylphosphate wherein the alkyl group is a butyl group, having a phosphorus content of 7.5 mass %, and contains a diluent. Additive package I is a package of a polymethacrylate viscosity index improver, phenol and amine anti-oxidants, a succinimide ashless dispersant, and the like, whereas additive package II is an SG grade package containing zinc dithiophosphate, calcium sulfonate, and the like.

(Performance Test)

(1) High Temperature Detergency Test (Hot Tube Test (HTT))

The high temperature detergency of each lubricant composition was tested in accordance with JPI-5S-55-99. Specifically, a soft glass tube was heated in a pure aluminum block to 270° C., and a test oil was introduced into this tube at a rate of 0.3 ml/hr and air at a rate of 10 ml/min, continuously for 16 hours. After the test, the tube was washed with petroleum ether, and the high temperature detergency was evaluated from the deposits on the inner tube surface. The ratings were made on a scale from 10, meaning colorless and transparent (no deposit) to 0, meaning black and opaque, at the interval of 0.5.

(2) Engine Motoring Friction Test

The engine motoring friction test was conducted under the following conditions, using, as engine shims, an ordinary steel shim and a shim coated with a DLC film as mentioned above. On the basis of the friction torque obtained when the ordinary steel shim and the lubricant of Comparative Example 1 were used, a friction torque reduction rate was measured for a combination of the shim coated with a DLC film and the above lubricant. The results are shown in Table 1.

Incidentally, the engine motoring friction test is for measuring friction torque of an engine as a whole, and allows comprehensive evaluation of friction reduction performance in the boundary lubrication areas, mixed lubrication areas, and hydrodynamic lubrication areas, compared to the SRV friction test for evaluating the boundary lubrication areas. Further, since only the shim was coated with a DLC film among all the lubrication points in the engine lubricated with the same lubricant, the present test allows evaluation of the friction reduction performance of a system wherein not only the DLC contact surfaces but also the non-DLC contact surfaces with no DLC films mainly made of steel, of an ordinary engine are lubricated at the same time.

TEST CONDITIONS

A: oil temperature at 100° C., engine revolution at 700 rpm
B: oil temperature at 60° C., engine revolution at 3500 rpm

TABLE 1

| | Ex. 1 | Ex. 2 | Ex. 3 | Ex. 4 | Ex. 5 | Ex. 6 | Ex. 7 | Ex. 8 | Ex. 9 | Ref. Ex. 1 | Comp. Ex. 1 |
|---|---|---|---|---|---|---|---|---|---|---|---|
| Base oil (mass % based on total amount of base oil) | | | | | | | | | | | |
| Base oil I (Lubricant base oil (A)) | 100 | 100 | 100 | 100 | 100 | 100 | 100 | 100 | 100 | 100 | 100 |
| Additive (mass % based on total amount of lubricant) | | | | | | | | | | | |
| (B) Sulfur-containing molybdenum complex | 0.5 | 0.2 | 0.5 | 0.5 | 0.5 | 0.5 | 0.5 | 0.5 | 0.5 | — | — |
| (C) Friction modifier I | 1.0 | 1.0 | — | 1.0 | — | — | 1.0 | 1.0 | — | 1.0 | — |
| (D) Metal detergent I | 3.0 | — | — | — | 3.0 | — | 3.0 | — | 3.0 | — | — |

TABLE 1-continued

| | Ex. 1 | Ex. 2 | Ex. 3 | Ex. 4 | Ex. 5 | Ex. 6 | Ex. 7 | Ex. 8 | Ex. 9 | Ref. Ex. 1 | Comp. Ex. 1 |
|---|---|---|---|---|---|---|---|---|---|---|---|
| (D) Metal detergent II | — | 3.0 | — | — | — | — | — | — | — | 3.0 | — |
| (E) Phosphorus-based anti-wear agent I | 1.1 | — | — | — | — | 1.1 | — | 1.1 | 1.1 | 1.1 | — |
| (E) Phosphorus-based anti-wear agent II | — | 1.0 | — | — | — | — | — | — | — | — | — |
| Additive package I | 11 | 11 | 11 | 11 | 11 | 11 | 11 | 11 | 11 | 11 | — |
| Additive package II | — | — | — | — | — | — | — | — | — | — | 13.6 |
| High temperature detergency test HTT (270° C.) | 10 | 10 | 5 | 7 | 10 | 7 | 10 | 10 | 10 | 10 | 10 |
| Results of performance test | | | | | | | | | | | |
| Engine motoring friction test - shim | a-C | a-C | a-C | a-C | a-C | a-C | a-C | a-C | a-C | a-C | steel |
| Friction torque reduction rate (%) | | | | | | | | | | | |
| 700 rpm, 100° C. | 20.4 | 19.0 | 13.5 | 25.4 | 11.2 | 13.5 | 22.4 | 18.4 | 11.2 | 10.2 | 0 (std) |
| 3500 rpm, 60° C. | 6.5 | 8.0 | 6.3 | 9.1 | 5.6 | 9.2 | 6.0 | 9.5 | 8.5 | 5.3 | 0 (std) |

In Table 1, it is shown that, when the shim coated with a DLC film and the lubricant of an Example were used, a superior friction torque reduction rate was achieved under higher temperature, low revolution conditions, compared to the friction torque achieved when the ordinary steel shim and the lubricant of Comparative Example 1 were used. In particular, with the lubricant of Example 1, an extremely excellent friction torque reduction rate of over 20% was achieved. Similarly, with the lubricant of Example 2, an extremely excellent friction torque reduction rate of 19% was achieved. It is thus demonstrated that the lubricants of the present invention are not only effective on the DLC contact surfaces, but also have extremely excellent friction reduction performance in a system having non-DLC contact surfaces in addition to the DLC contact surfaces.

What is claimed is:

1. A system having diamond-like carbon (DLC) contact surfaces, comprising:

a pair of relatively movable, facing DLC contact surfaces at least one of which is coated with a film of at least one of a-C (amorphous carbon) DLC and a-C:H (hydrogenated amorphous carbon) DLC, and a lubricant (L) interposed between said DLC contact surfaces, said lubricant (L) comprising:

a lubricant base oil (A) containing a base oil (X) as a main component, a 0.001 to 0.2 mass % molybdenum dithiocarbamate as a sulfur-containing molybdenum complex (B) in terms of molybdenum elements, at least one friction modifier (C) selected from C1-C40 esters of aliphatic monocarboxylic acids, and a sulfur-free metal detergent (D) selected from alkali metal or alkaline earth metal salicylates, wherein said base oil (X) consists at least one of a hydrocracked mineral oil, a wax-isomerized mineral oil, and a poly-α-olefin base oil, and has a kinematic viscosity of 3.5 to 5 $mm^2/s$ at 100° C., a total aromatic content of 0 to 2 mass %, and a total sulfur content of not higher than 0.002 mass % wherein a content of said friction modifier (C) is 0.05 to 3.0 mass %, and a content of said sulfur-free metal detergent (D) is 0.01 to 1 mass % in terms of metal elements, based on a total amount of said lubricant (L).

2. The system according to claim 1, wherein said lubricant (L) further comprising a phosphorus-based anti-wear agent (E).

3. The system according to claim 1, wherein said lubricant base oil (A) has substantially no sulfur content.

4. The system according to claim 1, wherein said DLC contact surfaces are contact surfaces provided in an internal combustion engine.

5. The system according to claim 1, further comprising, in addition to said DLC contact surfaces, a pair of relatively movable, facing non-DLC contact surfaces having no DLC film, wherein said lubricant (L) is interposed both between said DLC contact surfaces and between said non-DLC contact surfaces.

6. A method of lubricating a system of claim 1, comprising lubricating a pair of relatively movable, facing DLC contact surfaces at least one of which is coated with a film of at least one of a-C (amorphous carbon) DLC and a-C:H (hydrogenated amorphous carbon) DLC, with a lubricant (L) interposed between said DLC contact surfaces, said lubricant (L) comprising:

a lubricant base oil (A) containing a base oil (X) as main component, a 0.001 to 0.2 mass % molybdenum dithiocarbamate as a sulfur-containing molybdenum complex (B) in terms of molybdenum elements, at least one friction modifier (C) selected from C1-C40 esters of aliphatic monocarboxylic acids, and a sulfur-free metal detergent (D) selected from alkali metal or alkaline earth metal salicylates, wherein said base oil (X) consists at least one of a hydrocracked mineral oil, a wax-isomerized mineral oil, and a poly-α-olefin base oil, and has a kinematic viscosity of 3.5 to 5 $mm^2/s$ at 100° C., a total aromatic content of 0 to 2 mass %, and a total sulfur content of not higher than 0.002 mass % wherein a content of said friction modifier (C) is 0.05 to 3.0 mass %, and a content of said sulfur-free metal detergent (D) is 0.01 to 1 mass % in terms of metal elements, based on a total amount of said lubricant (L).

7. The method according to claim 6, wherein said lubricant (L) further comprising a phosphorus-based anti-wear agent (E).

8. The method according to claim 6, wherein said lubricant base oil (A) has substantially no sulfur content.

9. The system according to claim 1, wherein said esters of aliphatic monocarboxylic acids as friction modifier (C) comprise glycerin monooleate.

10. The system according to claim 2, wherein a content of said phosphorus-based anti-wear agent (E) is 0.01 to 0.1 mass % in terms of phosphorus elements based on a total amount of said lubricant (L).

11. The method according to claim 6, wherein said esters of aliphatic monocarboxylic acids as friction modifier (C) comprise glycerin monooleate.

12. The method according to claim 7, wherein a content of said phosphorus-based anti-wear agent (E) is 0.01 to 0.1 mass % in terms of phosphorus elements based on a total amount of said lubricant (L).

* * * * *